US005851630A

United States Patent [19]

Davis, II

[11] Patent Number: 5,851,630

[45] Date of Patent: Dec. 22, 1998

[54] CONTAINER AND BLANK FOR "DUCKBILL" ELIMINATION

[75] Inventor: Denny Earl Davis, II, Covington, Va.

[73] Assignee: Westvaco Corporation, New York, N.Y.

[21] Appl. No.: 788,334

[22] Filed: Jan. 27, 1997

[51] Int. Cl.[6] ..... B32B 3/00; B65D 5/74

[52] U.S. Cl. ..... 428/155; 428/167; 428/542.8; 220/62; 229/137; 229/138; 229/125.42

[58] Field of Search ..... 428/542.8, 156, 428/192, 155, 141, 167, 211; 229/137, 138, 125.42; 220/62

[56] References Cited

U.S. PATENT DOCUMENTS

| | | | |
|---|---|---|---|
| 3,156,401 | 11/1964 | Krause | 229/4.5 |
| 3,157,339 | 11/1964 | Negoro | 229/5.5 |
| 3,164,068 | 1/1965 | Linacre et al. | 93/35 |
| 3,242,829 | 3/1966 | White | 93/94 |
| 3,280,709 | 10/1966 | Elam | 93/94 |
| 3,365,111 | 1/1968 | McNair, Jr. et al. | 229/17 |
| 3,380,648 | 4/1968 | De Lyra | 229/71 |
| 3,537,634 | 11/1970 | Collie | 229/17 |
| 3,540,354 | 11/1970 | Tachibana et al. | 93/1 |
| 3,552,238 | 1/1971 | Wilson | 93/52 |
| 3,623,633 | 11/1971 | Kinn | 220/94 R |
| 3,633,816 | 1/1972 | Alton | 229/69 |
| 3,716,435 | 2/1973 | Jensen et al. | 156/195 |
| 3,776,108 | 12/1973 | Nock | 93/39 R |
| 3,817,444 | 6/1974 | Yoch | 229/48 R |
| 3,931,923 | 1/1976 | Thurston | 229/23 R |
| 4,008,650 | 2/1977 | Alter et al. | 93/62 |
| 4,011,984 | 3/1977 | Matovich, Jr. | 229/37 R |
| 4,281,787 | 8/1981 | Hensey | 229/176 |
| 4,332,577 | 6/1982 | Mosse | 493/74 |
| 4,343,427 | 8/1982 | Sansbury | 229/4.5 |
| 4,491,267 | 1/1985 | Tisma | 229/37 R |
| 4,548,593 | 10/1985 | Tisma | 493/56 |
| 4,582,552 | 4/1986 | Fitzgibbon et al. | 156/217 |
| 4,692,132 | 9/1987 | Ikushima et al. | 493/103 |
| 4,730,766 | 3/1988 | Fear | 229/137 |
| 4,753,832 | 6/1988 | Brown et al. | 428/481 |
| 4,785,992 | 11/1988 | Goeppner | 229/5.6 |
| 4,795,086 | 1/1989 | Färber | 229/137 |
| 4,846,396 | 7/1989 | Palazzolo | 229/52 B |
| 4,860,902 | 8/1989 | Kieser | 206/631.3 |
| 4,863,093 | 9/1989 | DuCorday | 229/1.5 R |
| 4,909,434 | 3/1990 | Jones et al. | 229/125.15 |
| 4,915,236 | 4/1990 | Kamin | 206/621.6 |
| 4,964,562 | 10/1990 | Gordon | 229/125.15 |
| 4,974,772 | 12/1990 | Spurrell et al. | 229/125.42 |
| 5,031,382 | 7/1991 | Boyle | 53/411 |
| 5,083,702 | 1/1992 | Wyberg | 229/125.42 |
| 5,110,040 | 5/1992 | Kalberer | 229/125.14 |
| 5,143,281 | 9/1992 | Mainz et al. | 229/132 |
| 5,176,308 | 1/1993 | Frazier | 229/137 |
| 5,255,494 | 10/1993 | Doyle | 53/477 |
| 5,263,637 | 11/1993 | Simson | 229/304 |
| 5,337,538 | 8/1994 | Ljungström | 53/456 |
| 5,363,981 | 11/1994 | Giblin et al. | 220/416 |
| 5,364,022 | 11/1994 | Ganz | 724/198.2 |

*Primary Examiner*—Donald Loney
*Attorney, Agent, or Firm*—J. R. McDaniel; R. L. Schmalz

[57] ABSTRACT

This invention relates to a blank, which when formed into a gable-top container with an extensible pouring spout, eliminates "duckbilling" and allows the gable-top container to form more easily. Such structures of this type, generally, eliminate "duckbilling" or the folding out of the pouring spout through the use of reverse or inverted score lines located in the top of the gable-top container.

6 Claims, 4 Drawing Sheets

CONTAINER AND BLANK FOR "DUCKBILL" ELIMINATION

BACKGROUND OF THE INVENTION

1. Field of the Invention

This invention relates to a blank, which when formed into a gable-top container with an extensible pouring spout, eliminates "duckbilling" and allows the gable-top container to form more easily. Such structures of this type, generally, eliminate "duckbilling" or the folding out of the pouring spout through the use of reverse or inverted score lines located in the top of the gable-top container.

2. Description of the Related Art

The present invention relates to gable-top containers with extensible pour spouts, and more particularly to the "duckbilling" or the tendency of the pouring spout to pop out, prior to the sealing of the container. The invention finds utility in the manufacture of gable-top containers for the use in packaging fluids, for example, milk, juices, syrups and other liquid or powdered products.

Gable-top containers are presently used in a number of liquid or powder applications. Their style is well known to most end-users from school children to adults. Such containers are generally prepared from paperboard having its overall inner and outer surfaces coated with a thermoplastic coating, i.e., low density polyethylene (LDPE), which provides a moisture barrier, and allows the container to be side seamed under heat and pressure for shipping, and ultimately bottom formed and top closed with the aid of heat and pressure when the containers are formed and filled. Exemplary of such prior art containers are U.S. Pat. No. 3,365,111 ('111) to J. W. McNair, Jr., et al., entitled "Laminated Container", U.S. Pat. No. 4,332,577 ('577) to R. W. E. Mosse, entitled "Packaging", U.S. Pat. No. 4,860,902 ('902) to W. Kieser, entitled "Sealing of Container Closure", U.S. Pat. No. 5,083,702 ('702) to G. R. Wyberg, entitled "Gable-Top Container Method and Apparatus for Construction Thereof", and U.S. Pat. No. 5,255,494 ('494) to E. P. Doyle, entitled "Method and Apparatus for Forming Carton Opening Arrangement and Cartons Made Thereby". While these patents involve the use of a gable-top, none of them address the problem of "duckbilling".

Still other prior art employs the use of score lines for various reasons. Exemplary of such prior art is U.S. Pat. No. 5,337,538 ('538) to T. B. G. Ljungstrom, entitled "Gable-Top Carton Blank for Diverse Packaging Machines and Methods of Making and Using the Blank". In the '538 patent, the score lines are employed to allow the gable-top be formed on any side of the container. U.S. Pat. No. 4,846,396 ('396) to F. Palazzolo, entitled "Container Made of Folded Planar Material Having Precreased Gripping Area and Blank for Same and Method of Manufacture", incorporates additional score lines to form a collapsible grip section on the gable top carton. U.S. Pat. No. 4,795,086 ('086) to J. Farber, entitled "Gable-Topped Container", provides additional score lines to relieve stresses on the fold down flaps of a gable-top container. Consequently, while these references employ various uses for score lines, none are concerned with using score lines to eliminate "duckbilling".

Finally, prior art exists which employs the use of score lines adjacent to the inner roof panels of the gable-top container. Exemplary of such prior art is U.S. Pat. No. 4,281,787 ('787) to W. R. Hensey, entitled "Container and Blank for Constructing Same". The Hensey reference merely employs scores which are formed wider than the other scores to provide an easier folding of the gable-top container. However, a still further advantageous container would be one which employed score lines that reduced "duckbilling".

It is apparent from the above that there exists a need in the art for a blank which can be easily formed into a gable-top container with an extensible pouring spout, and which at least equals the performance characteristics of such gable-top containers, but which at the same time is able to eliminate "duckbilling". It is a purpose of this invention to fulfill this and other needs in the art in a manner more apparent to the skilled artisan once given the following disclosure.

SUMMARY OF THE INVENTION

Generally speaking, this invention fulfills these needs by providing an improved blank for gable-top containers that eliminates "duckbilling" and allows the gable-top container to form more easily, comprising a blank having inner and outer sides, with printed graphics being located on the outer side, and a coating layer located on the inner side, and further including a first side panel means hingedly connected to a second side panel means along a first vertical side panel score line means, a third side panel means hingedly connected to the second side panel means along a second vertical side panel score line means, a fourth side panel means hingedly connected to the third side panel means along a third vertical side panel score line means, and a side seam flap hingedly connected to the fourth side panel, wherein the blank further comprises end panel means foldable connected to the side panel means wherein a first end panel means is hingedly connected to one of the side panel means by a first horizontal end panel score line means and a second end panel means is hingedly connected to another side panel means along a second horizontal end panel score line means such that the second end panel means is located a distance of at least one of the side panel means away from the first end panel means, and the first and second end panel means are further applied with reversed diagonal score line means such that a raised area of the reversed diagonal score line means extends above the outer side of the blank to eliminate "duckbilling" of the extensible pour spout when the container is sealed.

In certain preferred embodiments, the diagonal score line means may be located on the first and third end panels or the second and fourth end panels. Also, the diagonal score lines extend from the intersection of the horizontal score lines and the vertical score lines, and are directed toward the center and top edge of the end panels. Finally, the first and second horizontal end panel score lines are located a predetermined vertical distance away from each other.

In another further preferred embodiment, substantially all of the "duckbilling" experienced by the prior art gable-top carton is eliminated through the use of the novel, reversed diagonal score lines means described herein.

The preferred gable-top container, according to this invention, offers the following advantages: ease of construction; excellent carton characteristics; good stability; good durability; good economy; and substantially reduced "duckbilling". In fact, in many of the preferred embodiments, these factors of ease of construction and reduced duckbilling are optimized to the extent that is considerably higher than heretofore achieved in prior, known gable-top containers.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
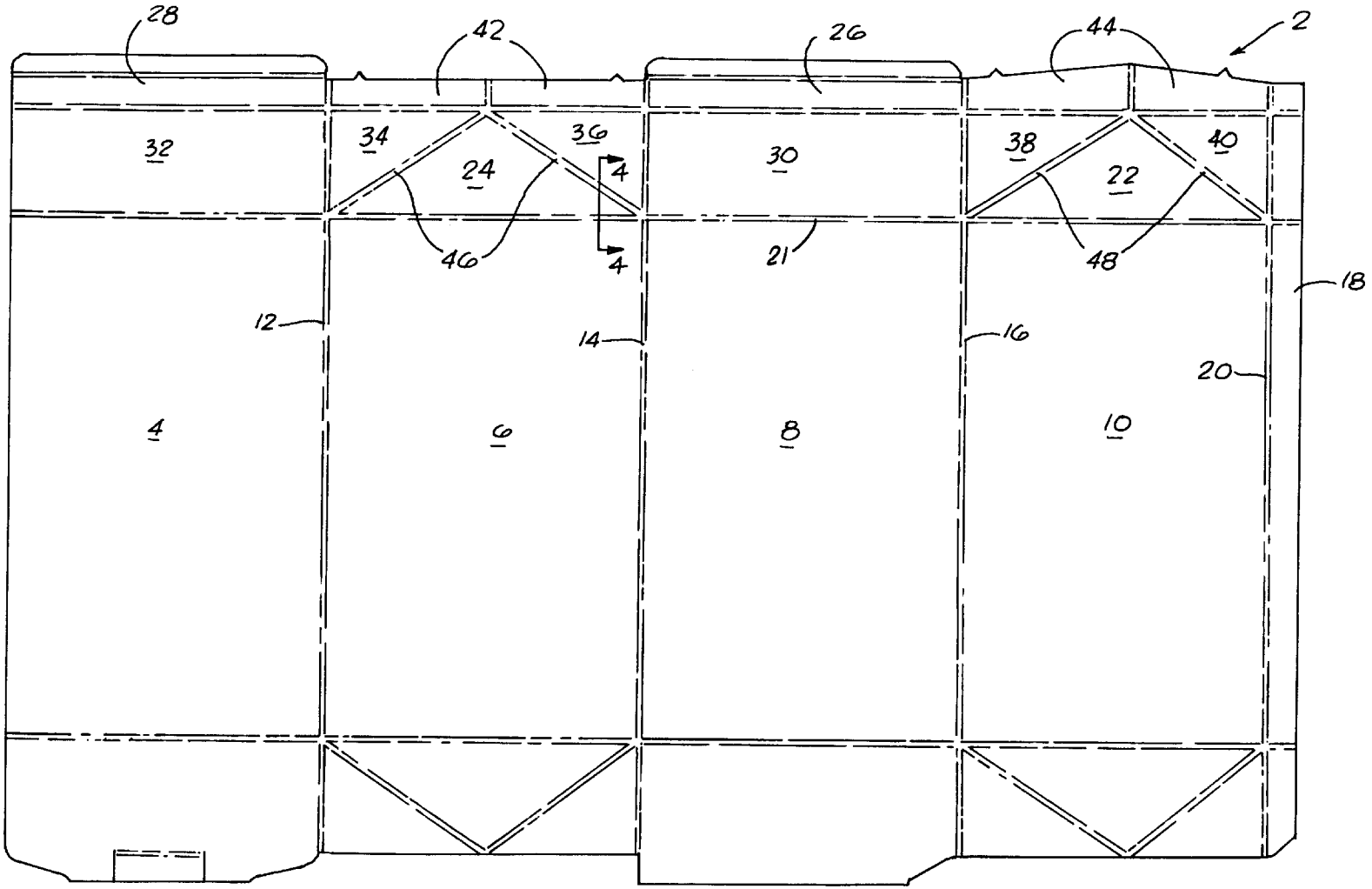
FIG. 1 (PRIOR ART)
FIG. 1 is a plan view of a blank for a gable-top container, according to the prior art.
Figure 2:
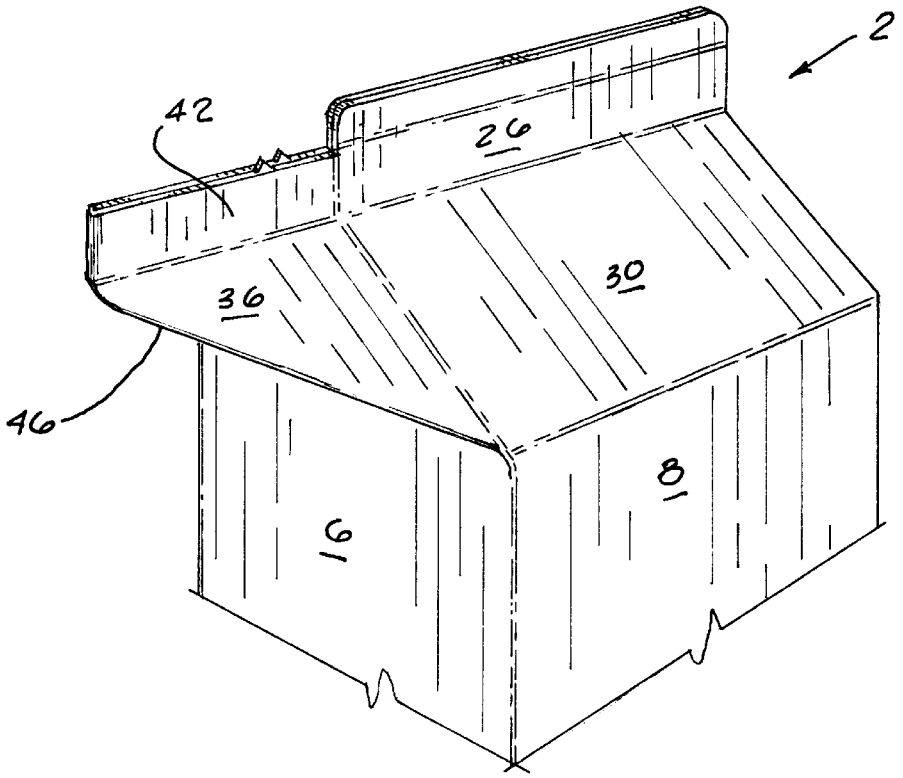
FIG. 2 (PRIOR ART)
FIG. 2 is a top perspective view of an assembled gable-top container from the blank of FIG. 1 exhibiting "duckbilling"
Figure 3:
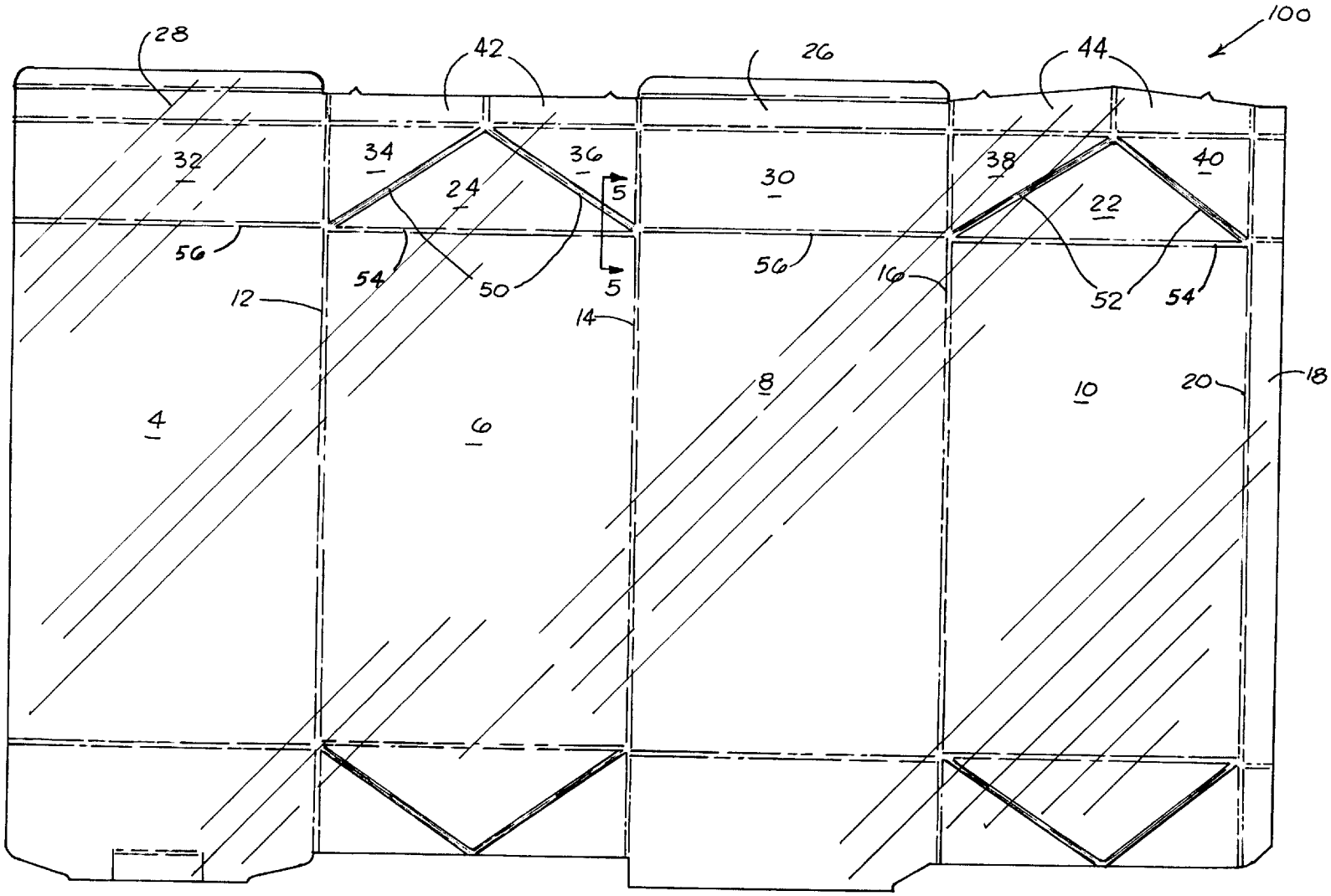
FIG. 3 is a plan view of a blank for a gable-top container having reduced "duckbilling", according to the present invention.

A typical gable-top container of the type in which the present invention is used is shown in FIGS. 1, 2 and 3. Such containers are illustrated in considerable detail in any one of a number of prior art patents, particularly those discussed above in the Description of the Related Art. However, for purposes of the present invention, it is sufficient to note that such containers may be formed from a foldable sheet material, i.e., paperboard or the like, and that they are self-sustaining in shape. The sheet material is rendered liquid or powder impervious and heat sealable with the use of a coating on both sides of a thermoplastic material, e.g., polyethylene, making the container useful for holding any number of different liquid or powdered materials. Where appropriate, the laminate so formed may include additional barrier coatings to prevent the egress or ingress of odors, oxygen or other permeable materials. The thermoplastic coatings serve as a heat sealable means for side seaming the containers and for forming the top and bottom closures in the conventional manner. Also, conventional printed graphics can be placed on the outside of the container, i.e., the side of the container not in contact with the liquid or powder.

Referring now to FIG. 1, there is shown a conventional blank 2 for a gable-top container currently found in use. Blank 2 is divided into a plurality of side panels 4, 6, 8 and 10 by vertical fold lines 12, 14 and 16, respectively, which form the body of blank 2 and a fifth panel or side seam flap 18 attached to panel 10 along a score line 20. The gable-top closure is formed by roof panels 30 and 32 which include upper sealing flaps 26 and 28, respectively, together with a pair of triangular end panels 22 and 24 joined to the adjacent roof panels 30 and 32, respectively, by triangular fold back panels 34, 36, 38 and 40. To complete the rib portion, each of the triangular fold back panels 34, 36, 38 and 40 includes adjacent their upper edges corresponding inner rib panels 42 and 44. As can be seen in FIG. 1, triangular fold back panels 34 and 36 are connected to triangular end panel 24 by conventional score lines 46 and triangular fold back panels 38 and 40 are connected to triangular end panel 22 by conventional score lines 48. Finally, conventional horizontal score lines 21 are shown.

Figure 4:
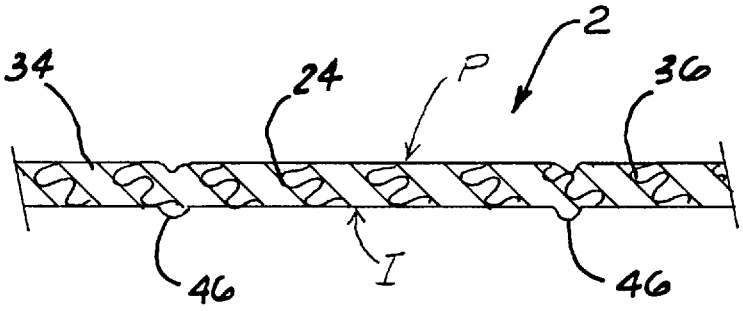
FIG. 4 is an end view, taken along lines 4—4 in FIG. 1, of the diagonal score lines in the end panel, according to the prior art.

As shown in FIG. 1, what is meant by conventional score lines 46 and 48 is that, typically, these score lines 46 and 48 are applied in such a manner that the scoring knives or elements are placed on the outside (i.e., the printed side (P) (FIG. 4) of the container) so that the raised areas produced by the scoring knives or elements project towards the inside (I) (FIG. 4) of the container. Score lines 46 and 48, preferably, are scored in this way so that triangular end panels 22 and 24 should move inwardly and towards each other as the gable-top container is being sealed. However, as will be discussed later, this inward movement is not always accomplished which can lead to a failure of the constructed gable-top center to retain the liquid or powder. This failure being referred to as "duckbilling".

After blank 2 has been folded into a gable-top carton according to conventional techniques such as those set forth in the above-referenced U.S. Pat. No. 3,365,111, the container can be filled with any suitable variety of liquids or powders. However, the manufacturer who fills the carton, typically, encounters a problem called "duckbilling", as shown in FIG. 2. "Duckbilling", occurs during the carton sealing process when the panels which comprise the extensible pouring spout fail to fold inwardly, and instead, enter the sealing unit in a popped out position.

In order to eliminate this "duckbilling", blank 100 was developed, as shown in FIG. 3. As shown in FIG. 3, blank 100 is divided into plurality of side panels 4, 6, 8 and 10 by vertical fold lines 12, 14 and 16 which form the body of blank 100, and a fifth panel or side seam flap 18 attached to panel 10 along a score line 20. The gable-top closure is formed by roof panels 30 and 32 which include upper sealing flaps 26 and 28 respectively, together with a pair triangular end panels 22 and 24 joined to the adjacent roof panels 30 and 32, respectively, by triangular fold back panels 34, 36, 38 and 40. To complete the rib portion, each of the triangular fold back panels 34, 36, 38 and 40 includes adjacent their upper edges corresponding inner rib panels 42 and 44. Finally, triangular end panels 22 and 24 include diagonal score lines 50 and 52, respectively. Finally, horizontal score lines 54 and 56 are shown. Score lines 54 and 56 are offset from each other in the vertical direction in order to allow blank 100 to be formed more easily into a container. This is because all of the folds from the various fold lines do not meet at the same small area at the corner of the container when the container is folded.

Figure 5:
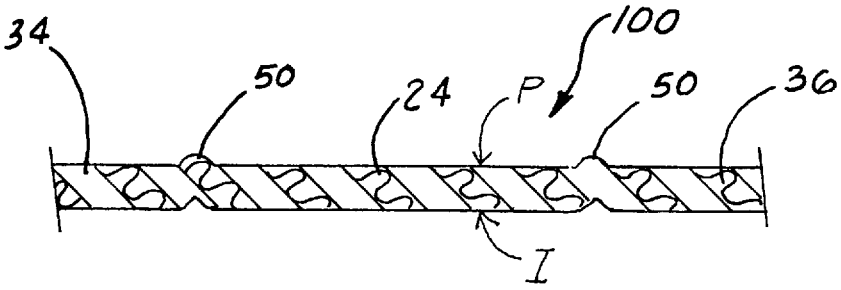
FIG. 5 is an end view, taken along lines 5—5 in FIG. 3, of the diagonal score lines in the end panel, according to the present invention.

As shown in FIG. 5, it is important to note with respect to diagonal score lines 50 and 52 that score lines 50 and 52 are reversed so that the raised areas produced by the scoring knives or elements project outwardly and away from triangular end panels 22 and 24, respectively toward the outside of the blank. In short, score lines 50 and 52 extend towards the printed side (P) of blank 100 because the scoring knives or elements are placed on the inside (I) of blank 100.

The effectiveness of the scoring concept of the present invention has been verified experimentally. In a conventional testing device, scores both conventional and according to the present invention were generated and then evaluated in a conventional score bending machine to determine the score bend ratio in terms of a percentage. The score bend ratio correlates with "duckbilling" in that a lower score bend ratio implies that it takes less force to pre-break the score in the filling machine. This pre-break bends the score enough to cause initial delamination of the score thereby initiating a folding bias which is taken advantage of in the sealer. The scores were then plotted in FIG. 6.

Figure 6:
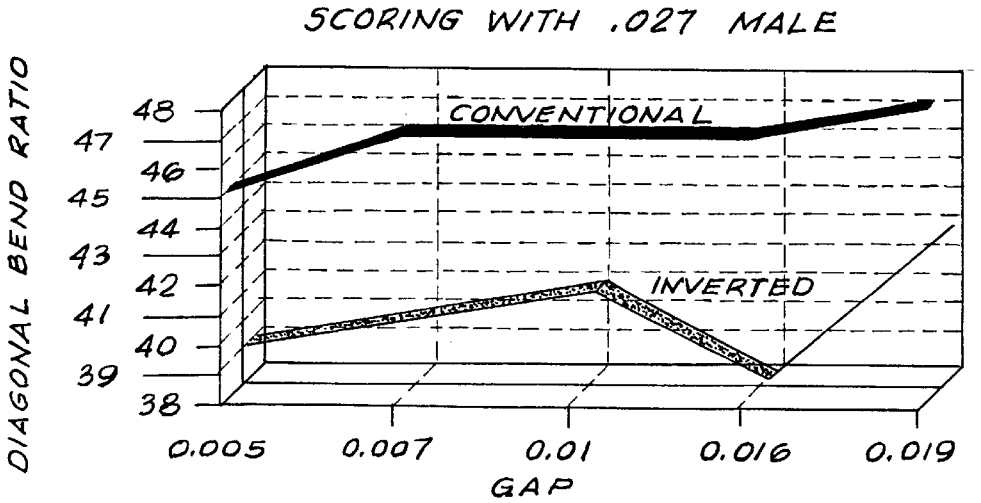
FIG. 6 is a graphical illustration of the elimination of duckbilling whereby the diagonal score bend ratio is plotted against gap in inches.

FIG. 6 shows the inverted score bend ratio of the present invention compared to the conventional score bend ratio for a variety of score geometries. For this example, several female scoring knives or rules were used to create different gaps with a constant sized male scoring rule. This type of testing was performed with a variety of male and female scoring rules at various penetrations and all demonstrated that the reversed scoring gave significantly lower bending ratios which results in the substantial elimination of "duckbilling".

Tables 1 and 2, below, show the score bend ratio for various male, female die geometries for the conventional and the inverted scoring method, according to the present invention. Tables 1 and 2 correspond to 15 and 7 thousandths of an inch die penetration, respectively. For this data, the score bend ratio percentage for the inverted scoring method, according to the present invention, decreased by about 10. As discussed above, a decrease in the score bend results in a reduced possibility of "duckbilling".

TABLE 1

Score Bend Ratio for Conventional/Present Invention Diagonal Scoring Method at 15 Thousandths Die Penetration.

| MALE/FEM | NA .089 | NB .91 | OC .094 | NC .1 | OD .103 |
|---|---|---|---|---|---|
| NB .027 | 45/39 | 47/40 | 47/41 | 47/38 | 48/43 |
| OA .028 | 47/35 | 45/38 | 50/40 | 45/36 | 49/45 |
| NC .03 | 48/37 | 50/43 | 45/40 | 47/38 | 55/43 |

TABLE 2

Score Bend Ratio for Conventional/Present Invention Diagonal Scoring Method at 7 Thousandths Die Penetration.

| MALE/FEM | NA .089 | NB .091 | OC .094 | NC .1 | OD .103 |
|---|---|---|---|---|---|
| OA .028 | 49/38 | 54/42 | 52/40 | 48/36 | 50/44 |
| NC .03 | 52/38 | 55/46 | 57/42 | 52/39 | 60/46 |

Additional testing was done under actual platen press conditions. Conventional cartons and cartons implementing the reversed score lines of the present invention were made under normal press conditions. From the data show in Table 3, below, it can be seen that the score bend ratio percentage for the cartons with the reversed score, according to the present invention, decreased by about 15 as compared to the conventional cartons. It can also be seen that there was little variation between the score bend ratios for the scores in other orientations.

TABLE 3

Score Bend Ration Under Press Conditions

| Die Geometry | Vertical | Horizontal | Diagonal |
|---|---|---|---|
| 28/88 Present Invention | 44 | 50 | 48 |
| 28/88 Conventional | 46 | 53 | 63 |

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An improved blank for gable-top container that eliminates duckbilling and allows the gable-top container to form more easily, wherein said container is comprised of:

a blank having inner and outer sides, with printed graphics being located on said outer side, and a coating layer located on said inner side, and further including a first side panel means hingedly connected to a second side panel means along a first vertical side panel score line means;

a third side panel means hingedly connected to said second side panel means along a second vertical side panel score line means;

a fourth side panel means hingedly connected to said third side panel means along a third vertical side panel score line means;

a side seam flap hingedly connected to said fourth side panel wherein said blank further comprises end panel means foldably connected to said side panel means wherein a first end panel means is hingedly connected to one of said side panel means by a first horizontal end panel score lines means and a second end panel means is hingedly connected to another side panel means along a second horizontal end panel score line means such that said second end panel means is located a distance of at least one of said side panel means away from said first end panel means; and said first and second end panel means are further comprised of a reversed diagonal score line means such that a raised area of said reversed diagonal score line means extends above said outer side of said blank to eliminate duckbilling of an extensible pour spout when said container is sealed.

2. The container, as in claim 1, wherein said first end panel means is hingedly connected to said second side panel means.

3. The container, as in claim 2, wherein said second end panel means is hingedly connected to said fourth side panel means.

4. The container, as in claim 2, wherein said first end panel means is hingedly connected to said first side panel means.

5. The container, as in claim 4, wherein said second end panel means is hingedly connected to said third side panel means.

6. The container, as in claim 1, wherein said first horizontal end panel score line is located a predetermined vertical distance away from said second horizontal end panel score line.

* * * * *